United States Patent [19]

Gladenbeck et al.

[11] 4,097,686

[45] Jun. 27, 1978

[54] OPEN-AIR OR OVERHEAD TRANSMISSION CABLE OF HIGH TENSILE STRENGTH

[75] Inventors: Jürgen Gladenbeck, Röttgen; Gerald Müller, Cologne; Karl Schörken, Nettetal, Hinsbeck; Hans-Peter Schwindenhammer, Cologne, all of Germany

[73] Assignee: Felten & Guilleaume Carlswerk Aktiengesellschaft, Köln-Mülheim, Germany

[21] Appl. No.: 762,958

[22] Filed: Jan. 27, 1977

Related U.S. Application Data

[63] Continuation of Ser. No. 695,652, Jun. 14, 1976, abandoned, which is a continuation of Ser. No. 495,121, Aug. 2, 1974, abandoned.

[30] Foreign Application Priority Data

Aug. 4, 1973 Germany ..... 2339676

[51] Int. Cl.[2] ..... H01B 5/10

[52] U.S. Cl. ..... 174/131 A; 174/113 C

[58] Field of Search ..... 174/131 A, 113 C, 113 R

[56] References Cited

U.S. PATENT DOCUMENTS

| | | | |
|---|---|---|---|
| 2,277,177 | 3/1942 | Wermine | 174/131 A |
| 3,710,006 | 1/1973 | Davis | 174/113 C |
| 3,717,720 | 2/1973 | Snellman | 174/131 A |

OTHER PUBLICATIONS

Moore "A New Organic High Modulus Reinforcing Fiber" Dupont, Wilmington, Del.

*Primary Examiner*—E. A. Goldberg
*Attorney, Agent, or Firm*—Michael J. Striker

[57] ABSTRACT

The cable comprises a plurality of electrical conductor elements and a plurality of tensile load-bearing elements combined with the conductor elements to form the cable. The tensile-load-bearing elements are made of high-tensile strength synthetic plastic material.

4 Claims, 6 Drawing Figures

FIG. 4
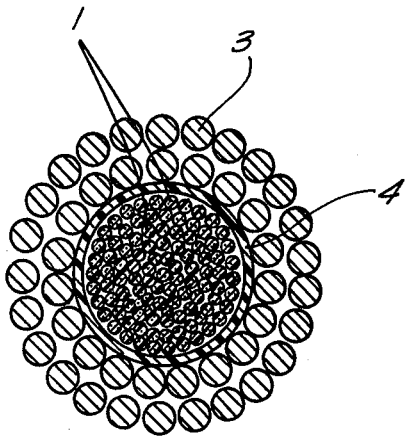
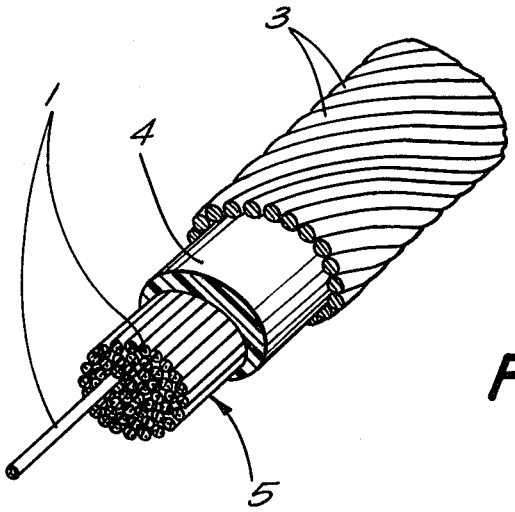
FIG. 5

OPEN-AIR OR OVERHEAD TRANSMISSION CABLE OF HIGH TENSILE STRENGTH

This is a continuation, of application Ser. No. 695,652, filed Jun. 14, 1976 now abandoned which was a continuation of application Ser. No. 495,121 filed Aug. 2, 1974 and abandoned.

The invention relates to a high-voltage overhead or open-air energy transmission cable of the type comprised of elements capable of withstanding the tensile loads encountered in the use of such lines and further comprised of electrical conductors. The invention furthermore relates to a method and an apparatus for the manufacture of such transmission cables.

Overhead or open-air energy transmission cables comprised of steel cable cores adapted to withstand the tensile loads to which the transmission cables are subjected are already well known in the art. They are employed for high-power energy-transmission purposes when great distances are to be bridged, and it is desired that the individual lengths of the transmission cables be each capable of bridging the greatest distance possible. The tensile loads to which the transmission cable is subjected, resulting predominantly from the weight of the cable itself, but also resulting from other causes such as loading, by the wind for example, are taken up by the steel cable. The steel cable is surrounded by and serves as the core for a plurality of electrical conductors, for example in the form of copper or aluminum wires, wound around the steel cable core in one or more layers. Because the steel cable bears the tensile load, the surrounding electrical conductors remain substantially unstressed.

Furthermore, it is also known to use steel wires which are covered over with electrically conductive material, such as copper or aluminum, these wires being known as copper or aluminum-sheathed steel core wires. These steel core wires are formed into a cable either by being twisted together or else by being twisted around a steel core cable. For example, use is made of steel-wire core cables having a tensile strength of between 120 and 200 kp/mm$^2$, and it is in general desired to provide the tensile-load-bearing components of the cable with a still greater tensile strength and/or with a lesser weight, in order to be able to reduce the cross-sectional area of the cable and in order to be able to increase the tensile stress to which the overhead transmission cable can be subjected and to accordingly increase the distance between the successive pylons which it bridges. Hightensile-strength steel, besides its high weight, additionally has the disadvantage that it is relatively brittle, and therefore undesirably sensitive to impact forces and to clamping stresses. As a result, such steel cannot be used when conventional connection techniques for overhead transmission cables, involving the use of clamps, are resorted to.

German Offenlegungsschrift No. 1,515,931 accordingly proposes an overhead transmission cable for the transmission of electrical energy at high and extremely high voltages comprised of an electrical conductor having a plurality of wire strands, with at least two different types of metal wire strands, the first type of metal wire strand being made of conductive aluminum and the second type being made of an aluminum-magnesium-boron-slicon alloy. The electrical conductivity of the first type of metal wire strand employed is greater than that of the second type; however, the tensile strength elasticity of the second type is greater than that of the first type.

All these known open-air or overhead transmission cables have the disadvantage that, because of the metal wires, especially steel wires, employed for the supporting and tensile load-bearing element, the transmission cable has a relatively great weight. For example, in the case of an open-air transmission cable having a cross section such that the cross-sectional area of the aluminum is six times the cross-sectional area of the steel, the steel component per unit length amounts to about 30 wt.-%, and this weight of steel wire has a negative effect, in the sense that it makes necessary a smaller spacing between successive pylons for the transmission cable.

The use of wires or wire strands of different aluminum alloys for the conductor or for the tensile-load bearing element of an open-air transmission cable results in no significant improvement, because the lower tensile strength of wires made of aluminum alloys, in comparison to steel wires, makes necessary the use of a greater number of wires, which again results in a net weight increase of the transmission line, as will be evident from the comparison table presented further below.

It is a general object of the invention to provide a high-voltage open-air or overhead transmission cable having tensile-load-bearing elements, with the transmission line, in comparison to prior-art transmission cables having the same cross-sectional area but having a considerably lesser weight and a considerably greater tensile strength.

It is another object of the invention to provide a method for making the novel transmission cable.

These objects, and others which will become more understandable from the description, below, of specific embodiments, can be met, according to one advantageous concept of the invention, by providing an open-air or overhead transmission cable of the general type discussed above, but differing from what is known in the prior art in the fact that the tensile-load-bearing elements are high-tensile-strength synthetic plastic filaments or yarns or twines formed from such filaments.

The expression "high-tensile-strength synthetic plastic filaments" is to be understood to include filaments made of aromatic homo- or copolyamides, for example m-phenylenediamine and terephthalic acid, and having the physical form of very thin continuous monofilaments. As a rule, these are combined in parallel to form filament bundles or else twisted together to form yarn or twine. Such high-tensile-strength plastic filaments having a specific weight considerably lower than that of metal wires, especially steel wires, have mechanical characteristics, especially tensile strength and breaking elongation, which, in comparison to steel wires, have values which are at least comparable when not actually superior. This can be seen from the following table:

| Material | tensile strength kg/mm$^2$ | elasticity modulus kg/mm$^2$ | breaking elongation % | specific weight g/cm$^3$ |
|---|---|---|---|---|
| steel wires | 150–210 | 20,000 | 0.8–1.0 | 7.80 |
| Al 6201 wires | 30–50 | 500–800 | ca. 6.0 | 2.70 |
| plastic filaments | 250–350 | 14,000 | 2.0 1.47 | |

In order to have available a typical comparison value for the different materials, resort is had to a quantity known as the "breaking length", defined as the tensile strength of the material in question divided by the specific weight of the material. The breaking length for steel wires is 20–27 km, for aluminum wires 11–18 km, and for high-tensile-strength synthetic plastic filaments of the type of interest 170–240 km. Here, for purposes of illustration, the synthetic plastic filaments employed were made of a copolyamide known under the commercial designation "PRD-49 Type 3 ", this material having strength characteristics which excel those of the polyamides and polyesters known under the names "Nylon", "Perlon" or "Trevira".

When use is made of the steel wires whose characteristics are listed in the above table, only about one-half the actual tensile strength is utilized, since the elastic limit of such steel wires amounts to only about half the tensile strength of the wires. In comparison to such steel wires, the synthetic plastic filaments whose characteristics are listed in the above table have a higher breaking elongation, but have a considerable advantage in that their stress-elongation characteristic is substantially linear and elastic right up to the breaking point. Accordingly, a greater component of the actual tensile strength can be utilized. In this connection, further reference may be had to the publication by Dr. Moore of the DuPont Corporation entitled "PRD-49, a new organic high modulus reinforcing fiber" the entire contents of which is incorporated herein by reference.

In an embodiment of the inventive open-air transmission cable preferred for certain purposes, use is made of bundles of parallel-oriented synthetic plastic filaments, or else use is made of synthetic plastic filaments twisted together to form yarns or yarn strands or twines, with the bundles, yarns, yarn strands or twines being impregnated with a hardenable material initially soft and elastomeric enough to be employed for impregnation purposes. When the finished cable is viewed in cross section, then proceeding in circumferential direction, electrical conductors will alternate with such bundles, yarns, yarn strands or twines, for example one electrical conductor, followed circumferentially by one filament bundle, followed circumferentially by the next electrical conductor, etc., with this alternating arrangement being employed in at least one layer of the finished cable. However, as another possibility, layers of synthetic plastic filaments or yarns or the like could alternate with layers of electrical conductors.

In another embodiment of the inventive open-air transmission cable, which is also considered very advantageous, synthetic plastic filaments or yarns oriented essentially parallel to each other and not twisted together are combined to form a cable core. This cable core is then in per se known manner surrounded with at least one layer of electrical conductors, preferably twisting around the cable core. The electrical conductors can, for example, be aluminum wires. When the inventive construction employs synthetic plastic filaments or synthetic plastic filament bundles which are oriented essentially parallel to each other and not twisted together, there is achieved the advantage that the tensile strength of the synthetic plastic filaments is utilized practically to the full extent.

In a variation of the construction just described, the cable core is comprised of an axial strand composed of parallel-laid highly stretchable synthetic plastic filaments surrounded by a layer, for example a twisting layer, of yarns or twines composed of high-tensile-strength synthetic plastic filaments. In this embodiment of the inventive transmission cable, it is essentially the outer layers of the high-tensile-strength synthetic plastic filaments which bear tensile loads, with the axial strand of highly stretchable synthetic plastic filaments, like filler material, being merely deformed without comparably contributing to the overall tensile strength of the inventive transmission cable. This embodiment of the invention is in particular advantageous for applications in which the fullest possible utilization of the tensile strength of the high-tensile-strength synthetic plastic filaments is of less importance than the maximizing of the flexibility of the entire transmission cable structure.

"Highly stretchable synthetic plastic filaments" which can be used for this purpose are synthetic plastic filaments having a breaking elongation between 10% and 20%, for example polyamide or polyester filaments ("Perlon", "Nylon", "Trevira" or the like).

By suitably selecting the material for the axial strand and, in the case of twisting, the twist length of the outer layers, the mechanical characteristics of the inventive transmission cable, such as tensile strength, weight, diameter, flexibility, elongation characteristics, fatigue strength under repeated reversed bending stresses, and the like, can be optimized for any particular application.

According to a further embodiment of the invention, it is advantageous to surround with an abrasion-resistant, flexible, preferably elastic sheath the synthetic plastic filaments or yarns which together form the cable core. Such a sheath, for example wound from an elongated synthetic plastic foil band, or else formed by a tubular web, or else constituted by a plastic layer provided on the outermost surface of the cable core, increases the useful life of the open-air or overhead transmission cable by increasing the abrasion-resistance at the outermost surface of the cable core, in addition to bringing about advantages relating to the method of manufacture, which will be explained below in connection with the discussion of the inventive method of manufacture.

In a further embodiment of the invention, it is also advantageous when the strands, yarns or twines composed of parallel-laid or twisted together synthetic plastic filaments are bonded together by impregnation with a material initially in a sufficiently liquid state to impregnate the filaments, while being adjustably hardenable or curable subsequently (into an elastomeric state), for example a resin. This impregnation can also be limited to the outermost surface layer. The impregnation serves, firstly, to hold together the parallel-oriented bundles or yarns to form a unitary strand and serves, secondly, to improve the transmission of force between the synthetic plastic filaments. Additionally, it counteracts strength reductions resulting from abrasive rubbing of the synthetic plastic filaments, between the axial strand of the cable core and the synthetic plastic filaments which surround and are twisted around the latter, and also between the outer surface of the cable core and the electrically conductive wires. The inventive impregnation of the transmission cable additionally facilitates manufacture of the cable, as will be described further below.

According to the invention, use is made of high-tensile-strength synthetic plastic filaments made of an aromatic homo- or copolyamide, made for example from m-phenylenediamine and terephthalic acid. The highly stretchable synthetic plastic filaments, having a breaking elongation between 10% and 20%, preferably between 15% and 20%, are made of a polyamide or a polyester. The use of these synthetic plastic materials has proved to be particularly advantageous.

Furthermore, according to the invention, the volume component of the impregnating material in the elements which bear tensile loads, after the hardening or curing or setting amounts to between 10% and 70%, preferably between 20% and 50%.

The inventive open-air or overhead transmission cable is characterized by the following advantages, as will become clearer from the examples presented below: The spaced pylon to be bridged by a length of the cable can be spaced further apart than possible with comparably dimensioned prior-art cables, and with less sag. Moreover, the pylons can be of lighter construction than necessary in the prior art, and the insulators can be lighter than necessary in the prior art. Furthermore, the assembly of transmission systems employing such cable and the repair of such systems is more economical than in the prior art, because of the smaller number of pylons employed, among other reasons. Also, because of the smaller number of pylons necessary, the appearance of the landscape and accordingly the environment in general is less affected.

EXAMPLE 1

In the case of a transmission cable intended for open-air overhead use having a rated cross section of 50/8 $mm^2$, the incorporation of the inventive arrangement of synthetic plastic filaments resulted in a 60% increase of the calculated breaking elongation of the cable, with the same total cross section. The weight of the cable per unit length was decreased by more than 25%. This made possible a 33% increase in the spacing between the two pylons for the length of cable in question, with the load-carrying capability of the cable not being fully utilized even in the case of maximal ice loading. Alternatively, if a bundle of high-tensile-strength synthetic plastic filaments of the same breaking load is employed, then there is about a 20% reduction in the cable diameter, with the weight reduction amounting to about 30%. This makes possible the use of pylons of lighter and accordingly less expensive construction.

EXAMPLE 2

In the case of an open-air or overhead transmission cable having a rated cross section of 120/70 $mm^2$, as a result of the incorporation of a strand of high-tensile-strength synthetic plastic filaments, and with no change in total cross section, the calculated breaking load more than doubled, while simultaneously the weight per unit length decreased by more than 50%. This made possible a doubling of the spacing between the pylons as compared to the spacing between the pylons when a similarly dimensioned aluminum-steel cable of the prior art is used, the load bearing ability of the masts with both types of cables being the same for purposes of comparison. On the other hand, if the core of this inventive transmission cable is formed by a strand of high-tensile-strength synthetic plastic filaments having the same breaking load as the cable core of a comparable prior-art cable, a 30% diameter reduction and a reduction of almost 60% in the weight of the cable can be achieved.

A high-voltage open-air or overhead transmission cable according to the invention can in advantageous manner be manufactured using a method according to which electrical conductors are applied to the tensile-load-bearing cable elements; for example, the electrical conductors can surround and twist around the tensile-load-bearing cable elements, or the electrical conductors and the tensile-load-bearing elements can be twisted together. Advantageously according to the invention prior to the combining of the electrical conductors and the tensile-load-bearing cable elements, high-tensile-strength synthetic plastic filaments or yarns are combined to form a strand of parallel-extending or twisted together filaments or yarns, and only then are pressed together.

According to another embodiment of the invention, the strand comprised of synthetic plastic filaments or the yarn composed of high-tensile-strength synthetic plastic filaments is impregnated with an initially liquid adhesive material, e.g., an elastomeric epoxy resin or novolak or an unvulcanized rubber mass, which material, upon a subsequent pressing together, preferably with the application of heat, cures into an elastomeric state. This inventive expedient results in the establishment of a good holding together of the individual filaments or yarns of each strand or bundle of filaments even before the actual assembling together of all the cable components. In the finished cable, this inventive expedient contributes to a uniform transmission of tensile forces by all the synthetic plastic filaments and furthermore contributes to the form-stability of the cable structure when the latter is subjected to tensile, bending, torsional and transverse loading forces. In a variation of this inventive method, it can be advantageous to impregnate and heat treat only the outer layer or layers of each strand of twisted together synthetic plastic filaments or of each strand of twisted together yarn.

Instead of or in combination with the above-described expedient, it is advantageous, according to a further concept of the invention, to surround the pressed-together synthetic plastic filaments or yarns with an abrasion-resistant, flexible, preferably elastic, sheath, for example a wound sheath formed by winding around the pressed-together filaments or yarns a synthetic plastic foil band or a tubular web, or else a layer of bendable synthetic plastic material extruded onto the pressed-together filaments or yarns immediately after the latter are pressed together. The provision of such a sheath is especially advantageous when the transmission cable for practical reasons is to be manufactured in separate operating steps. Such a sheath presses the synthetic plastic filaments together and accordingly additionally contributes to the form-stability of the entire cable structure. The sheath furthermore results in an increase of abrasion resistance of the entire cable structure and accordingly a marked increase of the useful life of the inventive transmission cable. It will be understood that, depending upon the characteristics desired for a particular transmission cable to be manufactured, its synthetic plastic filaments or yarns can either be impregnated in the above-described manner or surrounded with an elastic sheath, or both of these expedients can be employed in conjunction when the use to which the transmission cable will be put makes this advantageous.

According to a further embodiment of the invention, the synthetic plastic filaments or yarns and the electrical conductors can alternate in the circumferential direction of the cable and/or be arranged in alternating radially successive layers, intertwined with each other or else merely surrounding the twisting around the radially inwards neighboring layer. According to a further concept of the invention, the cable core formed of high-tensile-strength synthetic plastic filaments or yarns can be surrounded by at least one twisting layer of electrical conductors in per se known manner.

An arrangement which is exceptionally well suited for the performance of the inventive method is comprised of a frame which supports a plurality of supply reels for the synthetic plastic filaments or yarns, a pull-off arrangement downstream of these supply reels, an intermediate prossing arrangement, and at least one twisting arrangement, with all these apparatuses being arranged in series along a path of travel for the cable components and finished cable. Advantageously, the cable forming arrangement is further comprised of an impregnating arrangement for impregnating the synthetic plastic strand of filaments or strand of yarns with an initially liquid but settable or hardenable and/or adhesive material before the strand enters the pressing arrangement, the pressing arrangement in per se conventional manner being advantageously heatable. According to a further concept of the invention, the cable forming arrangement further includes an elongated oven chamber in the path of travel of the cable components downstream of the pressing arrangement, for the purpose of hardening and drying the impregnating material. According to a further concept of the invention, there is provided intermediate the pressing arrangement and the twisting arrangement an arrangement for applying a flexible sheath, for example a band-winding machine, an extruder, a tube-guiding machine, or the like, the drives for all the components of the cable forming apparatus being coupled with each other by means of a control arrangement.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawing.

FIG. 4 is a cross-sectional view of a third embodiment of the invention;

FIG. 5 is a perspective view of the embodiment of FIG. 4; and

Figure 1:
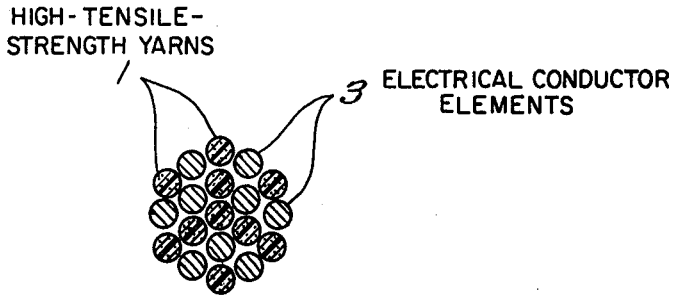
FIG. 1 is a cross-sectional view of a first embodiment of an open-air overhead transmission cable according to the invention.

In all Figures of the drawing, reference numeral 1 designates a yarn or twine composed of high-strength synthetic plastic filaments; in some Figures the filaments are oriented parallel to each other whereas in other Figures the filaments are twisted together to form a yarn-like structure.

Reference numeral 2 designates a yarn composed of highly stretchable synthetic plastic filaments.

Reference numeral 3 designates the electrical conductors, for example copper or aluminum wires, which are combined with such yarns or yarn strands to form an open-air or overhead transmission cable according to the invention.

In the embodiment shown in FIG. 1, yarns or yarn strands 1 composed of high-strength synthetic plastic filaments, which are impregnated with an elastomeric-like impregnating material, for example a hardenable resin, and electrical conductors 3 are so twisted together as to form a twisted cable which when viewed in cross section, is composed of radially successive layers, with each successive layer consisting of yarns or yarn strands 1 alternating in circumferential direction with electrical conductor elements 3.

Figure 2:
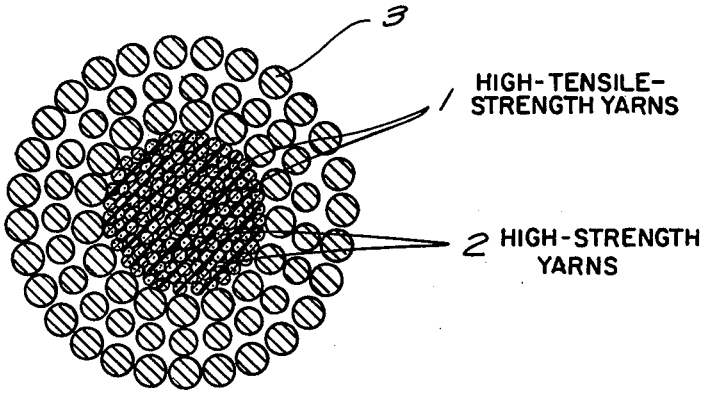
FIG. 2 is a cross-sectional view of a second embodiment of the invention.
Figure 3:
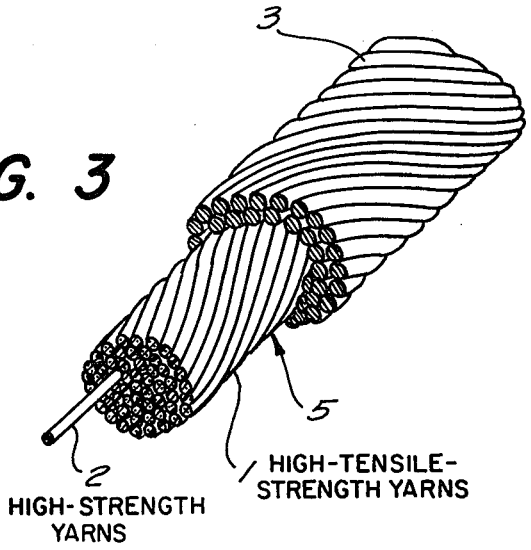
FIG. 3 is a perspective view of the embodiment of FIG. 2.

The transmission cable depicted in FIGS. 2 and 3 is comprised of a central core 5. The core 5 is comprised of yarns 2 composed of highly stretchable synthetic plastic filaments, for example made of "Perlon", "Nylon" or the like, and is further comprised of yarns 1 composed of high-tensile-strength synthetic plastic filaments. The yarns 2 and the yarns 1 which together form the core 5 are so arranged that the highly stretchable yarns 2 are located in the central portion of the cable core 5, whereas the high-tensile-strength yarns 1 are located at the peripheral portion of the core 5. As shown in FIG. 3, the highly stretchable yarns 2 can be arranged to extend parallel to each other, with the high-tensile-strength yarns 1 twisting around this inner core portion formed by the yarns 2. In such case, it is advantageous when at least the outer layers of the highly stretchable yarns 2 and of the high-tensile-strength yarns 1 are impregnated with the elastomer-like but hardenable or settable material. One or two layers of electrical conductors 3 twist around this core 5 in conventional manner.

The transmission cable depicted in FIGS. 4 and 5 differs from that shown in FIGS. 2 and 3. The main difference is that in FIGS. 4 and 5 the cable core 5 is surrounded by a highly abrasion-resistant sheath 4 of flexible, elastic synthetic plastic material which is extruded over the cable core 5. The elastic material of the sheath 4 can, for example, be polyethylene or latex. The sheath 4 by itself suffices to hold together the yarns and yarn strands of the core 5 and to guarantee the form stability of the core 5 and accordingly also of the overhead transmission cable as a whole, and accordingly in this embodiment it is possible to dispense with the impregnation bonding of the yarn strands 1 and 2. However, for certain purposes, for example when the cable is to be highly resistant to transverse flexing or when there are to be met especially strict requirements concerning prevention of water travel longitudinally through the cable, then the impregnation of the yarns or yarn strands 1, 2 can still be resorted to. In such case the electrical conductors 3 are wound around the flexible sheath 4 in one or more layers.

Figure 6:
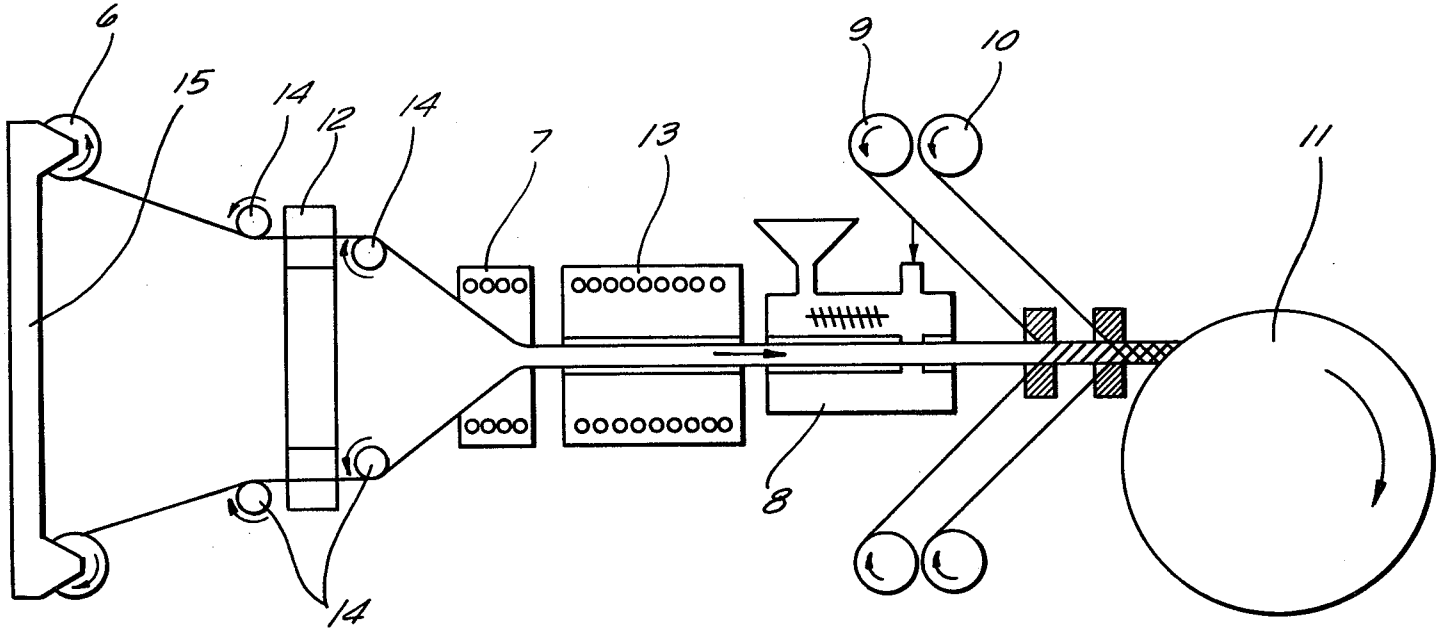
FIG. 6 is a schematic drawing of an arrangement for the manufacture of a high-voltage open-air or overhead transmission cable according to the invention.

FIG. 6 depicts in schematic manner an arrangement for making an open-air or overhead transmission cable according to the invention. The illustrated arrangement includes a frame 15 supporting a plurality of supply reels 6 for the high-tensile-strength yarns or yarn strands 1 and for the highly stretchable yarns or yarn strands 2. The arrangement further includes a pull-off arrangement in the form of a drum 11. Intermediate the frame 15 and the pull-off drum 11, there are provided, in the stated order, an impregnating arrangement 12 for the yarns and/or yarn strands, a pressing arrangement 7, an elongated oven chamber 13, an extruder 8 and twisting arrangements for the electrical conductors in the form of twisting carriages 9 and 10. Guide rollers 14 can be provided along the path of travel of the yarns or yarn strands upstream and/or downstream of the impregnating arrangement 12.

The impregnating arrangement 12 can be constructed in the form of a circular ring-shaped container having at the opposite axial sides thereof respective inlet and outlet openings for the travel of the yarns or yarn strands through the container, and with the inlet and outlet openings sealtightly engaging the entering and emerging portions of the yarn or yarn strands. The pressing arrangement 7 serves to combine together the filaments or yarns to form a strand having the desired cross-sectional form and composed of filaments or yarns oriented and extending parallel to each other. The arrangement 7 in per se known manner can be heated, so that the impregnated yarns, when they are pressed together in the arrangement 7 and subsequently dried in the elongated oven chamber 13, undergo a heat treatment to effect a setting or solidifying of the initially liquid impregnating material, for example by curing, vulcanization, or the like.

The yarn strand, after it emerges from the elongated oven chamber 13, passes through the extruder 8. If desired, as the yarn strand passes through the extruder 8 it is provided with a sheath of thermoplastic synthetic plastic material. The extruder 8 can be rendered inoperative or removed from the arrangement when such a sheath is not needed. As a further possibility, the extruder 8 can be replaced by another arrangement, for example an arrangement for forming a sheath around the cable core by winding an elongated foil band around the core to form the sheath. Also, there could be positioned at this location or else upstream of the impregnating arrangement twisting machines or arrangements for twisting together the filaments or yarns, in order to combine a plurality of filaments into one or more yarns or to combine a plurality of yarns into twisted cable-like structures, if this is desired. Alternatively, the supply reels 6 can be filled with twisted-together or untwisted yarn strands.

In the manner depicted here, the electrical conductors 3, by means of the oppositely rotating twisting carriages 9 and 10 are in conventional manner laid onto and twisted around the cable core 5 composed of high-strength synthetic plastic filaments and of highly stretchable filaments. It is to be understood that the cable core can be separately wound on a drum and that the cable forming can be effected at another location, when for practical reasons this is necessary, for example an account of lack of sufficient space.

In order to perform a simplified version of the inventive method, all that is needed is an arrangement with the frame 15, a pressing arrangement 7 which is this case need not be heatable, and an extruder 8 or a corresponding arrangement for providing the flexible sheath. Instead of the illustrated twisting carriages, use can be made of arrangements for laying on and twisting to form cables, operative for forming a cable of the types illustrated, namely comprised of pretreated synthetic plastic filaments or yarn strands and electrical conductors arranged in radially successive layers, with each such layer being composed of synthetic plastic filaments or yarn strands alternating in circumferential direction with electrical conductors.

It will be understood that each of the elements described above, or two or more together, may also find a useful application in other types of constructions differing from the type described above.

While the invention has been illustrated and described as embodied in an open-air or overhead transmission cable as well as a method and apparatus for the manufacture of one such transmission cable, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention.

What is claimed as new and desired to be protected by Letters Patent is set forth in the appended claims:

1. An uninsulated-conductor open-air or overhead transmission cable for the transmission of high-voltage electrical energy, comprising, in combination, a plurality of uninsulated electrical conductor elements; and a plurality of tensile-load-bearing elements combined with said plurality of uninsulated electrical conductor elements to form a cable, said tensile-load-bearing elements being made of high-tensile-strength aromatic homo- or copolyamide, and said uninsulated electrical conductor elements constituting the outermost elements of the uninsulated-conductor cable, said plurality of tensile-load-bearing elements being synthetic plastic yarns oriented generally straight and parallel to each other, the yarns being composed of high-tensile-strength aromatic homo- or copolyamide filaments, the cable further including a plurality of highly stretchable synthetic plastic filaments oriented generally straight and parallel to each other, the yarns and the highly stretchable synthetic plastic filaments being bound together to form a unitary core structure.

2. An uninsulated-conductor cable as defined in claim 1, wherein said highly stretchable synthetic plastic filaments have a breaking elongation between 10% and 20%.

3. An uninsulated-conductor cable as defined in claim 1, wherein said highly stretchable synthetic plastic filaments have a breaking elongation between 15% and 20%.

4. An uninsulated-conductor open-air or overhead transmission cable for the transmission of high-voltage electrical energy, comprising, in combination, a plurality of uninsulated electrical conductor elements; and a plurality of tensile-load-bearing elements combined with said plurality of uninsulated electrical conductor elements to form a cable, said tensile-load-bearing elements being made of high-tensile-strength aromatic homo- or copolyamide, and said uninsulated electrical conductor elements constituting the outermost elements of the uninsulated-conductor cable, said plurality of tensile-load-bearing elements being synthetic plastic yarns oriented generally straight and parallel to each other, the yarns being composed of high-tensile-strength aromatic homo- or copolyamide filaments, the cable further including a plurality of highly stretchable synthetic plastic filaments oriented generally straight and parallel to each other, the cable further including impregnating material impregnating the yarns and the highly stretchable synthetic plastic filaments, the impregnating material being in cured condition and elastomeric and forming together with the yarns and the highly stretchable filaments a unitary core structure.

* * * * *